United States Patent [19]

Michaels et al.

[11] Patent Number: 4,802,864

[45] Date of Patent: Feb. 7, 1989

[54] RIGHT ANGLE STRAIN RELIEF ADAPTER FOR ELECTRICAL CONNECTORS

[75] Inventors: Leonard H. Michaels, Warrenville; Robert A. Miller, Woodridge, both of Ill.

[73] Assignee: Molex Incorporated, Lisle, Ill.

[21] Appl. No.: 184,725

[22] Filed: Apr. 22, 1988

Related U.S. Application Data

[62] Division of Ser. No. 5,095, Jan. 20, 1987, Pat. No. 4,758,174.

[51] Int. Cl.[4] ..... H01R 13/58

[52] U.S. Cl. ..... 439/457

[58] Field of Search ..... 439/456, 457, 459, 470, 439/445, 452, 902; 174/81, 135

[56] References Cited

U.S. PATENT DOCUMENTS

| | | | |
|---|---|---|---|
| 1,579,618 | 4/1926 | Jensen | 174/81 |
| 4,220,387 | 9/1980 | Biche et al. | 439/445 |
| 4,385,793 | 5/1983 | Koford et al. | 439/445 |
| 4,678,867 | 7/1987 | Bongard et al. | 174/135 |

*Primary Examiner*—Gary F. Paumen

*Attorney, Agent, or Firm*—John W. Cornell; Louis A. Hecht

[57] ABSTRACT

An adapter molded from an elastomeric material is adapted to be mounted to an electrical connector having a cable extending therefrom, to provide a strain relief transition of the cable through a bend.

5 Claims, 4 Drawing Sheets

RIGHT ANGLE STRAIN RELIEF ADAPTER FOR ELECTRICAL CONNECTORS

This application is a division of prior application Ser. No. 005,045, filed Jan. 20, 1987, now U.S. Pat. No. 4,758,174.

BACKGROUND OF THE INVENTION

A substantial demand exists for electrical connectors to be used in industrial applications such as industrial control systems, signal circuits in instrumentation, sensing modules and switching systems. These electrical connectors typically accommodate at least two electrical conductors and a ground. Industrial electrical connectors may include a stationery half and a portable half. The stationery half may be mounted to a panel or other rigid structure that is operatively connected to the appropriate industrial circuitry. The portable half of the connector typically is mounted to a cable. In certain situations, however, electrical connectors are used to directly connect two cables to one another or to directly connect opposite panels of two electrical devices to one another.

Industrial electrical connectors often are employed in physically demanding environments, and therefore must be manufactured to withstand rugged use. More particularly, industrial electrical connectors often are subjected to impacts and torsional forces during connection and during disconnection. Similarly, industrial electrical connectors often are used in environments where they will be subjected to substantial physical impacts or severe vibrations during use. In view of these physical demands, a substantial number of the components of many prior art electrical connectors have been molded and/or machined from metallic materials.

The environments in which industrial electrical connectors are employed often will expose the connector to moisture, oil, fuels or other liquids that could cause severe damage to the metallic housings, to the electrically conductive members of the connector and to various electrical components to which the connector is joined. Thus, many prior art connectors have included elaborate sealing devices to prevent damage by moisture and other liquids present in the environment in which the connector is employed. These environmental seals typically have added substantially to the manufacturing cost and complexity of the connector and have made the manufacture and assembly of the connector more difficult.

Electrical connectors intended for industrial applications also should be capable of quick and reliable connection and disconnection. In particular, the electrical connector should be appropriately constructed to facilitate proper alignment of the conductors on each half of the connector. The respective halves of the connector should be capable of being placed in a secure connected condition without special tool, and should be securely retained in the connected condition in the presence of the above described environmental demands.

Industrial connectors also should be manufactured to accommodate the forces that inevitably will be placed upon the cable adjacent to the connector. Thus, forces exerted on the cable should not damage either the cable or the electrical connection between the cable and the connector. Damage often has been encountered when the cable must undergo a substantial bend adjacent the connector. Because of this potential problem, specially designed and manufactured right angle connectors often are employed. These right angle connectors substantially increase tooling costs and create inventory problems. When the right angle connector is not available to the field personnel, the cable will be abruptly bent adjacent to the connector, thereby causing a substantial probability of damage to the cable, the connector and/or the electrical connections within the connector.

One particularly desirble connector is shown in U.S. Pat. No. 4,472,012 which issued to Michaels on Sept. 18, 1984 and is assigned to the assignee of the subject invention. The connector shown in U.S. Pat. No. 4,472,012 is rugged, environmentally sealed and capable of secure but rapid connection and disconnection. Despite these many advantages, however, it is desirable to provide a connector of somewhat simpler design with fewer internal components. In particular, it is desirable to provide an electrical connector which, by virtue of its simpler design and fewer parts, can be manufactured at a lower cost and assembled easier than the connector shown in U.S. Pat. No. 4,472,012.

Other relevant connectors are shown in U.S. Pat. Nos. 4,150,866 which issued to Snyder, Jr. et al on Apr. 24, 1979; 4,193,655 which issued to Herrmann, Jr. on Mar. 18, 1980; 2,563,762 which issued to Uline et al on Aug. 7, 1951; and 3,029,407 which issued to Burton et al on Apr. 10, 1962. The connectors shown in each of the latter references are quite complex and either require a plurality of separate environmental seal members and/or provide an inadequate degree of environmental sealing. Furthermore, the relatively large number of internal components incorporated in these connectors contribute substantially to the manufacturing costs and to the assembly difficulties of said connectors.

In view of the above, it is an object of the subject invention to provide a small but rugged and environmentally sealed electrical connector.

It is another object of the subject invention to provide an environmentally sealed electrical connector of simple internal design and with a small number of internal components.

Another object of the subject invention is to provide an electrical connector that will substantially prevent damage to the connector by forces exerted on the cable.

A further object of the subject invention is to provide an electrical connector with an adapter to facilitate right angle bends of the cable and to prevent damage caused by such right angle bends of the cable.

SUMMARY OF THE INVENTION

The connector of the subject invention includes opposed matable connector halves, which may define a stationary half and a portable half. Each half of the connector includes a rigid outer shell. The rigid outer shells are configured to be securely mechanically connected to either a stationary structure, such as a panel, or to a portable structure such as a cable. The stationary rigid outer shell may be provided with external threads which are engageable with a standard nut to facilitate mounting to a panel. The portable rigid outer shell may be mechanically crimped to a cable to provide environmental sealing and strain relief. The extreme back end of the portable rigid outer shell may be flared outwardly to provide a smooth cable entrance. The rigid outer shells of the connector may be formed from metal or from suitable plastic. Preferably, the portable rigid outer shell is formed entirely from a metal, such as brass, which has been zinc plated to provide maximum strength and corrosion protection. The stationary rigid outer shell may be formed from a high impact glass filled polyester. These polyesters have high tensile and flexural strength, desirable heat deflection characteristics, excellent chemical resistance to gasoline, motor oil, transmission fluid, hydrocarbons and organic solvents, and good resistance to ketones, esters and mild acids at lower temperatures. High impact glass filled polyesters perform similarly to metal, but are cheaper and easier to manufacture.

Each half of the connector includes a one-piece elastomeric insert. Each elastomeric insert preferably is molded from a material having a high coefficient of friction which enables the respective inserts to be securely frictionally retained in the outer shells. The stationary elastomeric insert includes keys engagable with keyways formed in the rigid outer shells. These keys ensure polarized mating of the connector halves.

The elastomeric inserts in the respective connector halves differ from one another. More particularly, the portable elastomeric insert is provided with a forwardly directed peripheral lip on its mating face. This forwardly directed peripheral lip is compressed securely into contact with the mating face of the other elastomeric insert to contribute to the environmental sealing of the subject connector. The portable elastomeric insert further is provided with an outwardly .extending sealing flange at an intermediate location along its length. This outwardly extending sealing flange is disposed to be securely compressed against the rigid outer shells of the connector, and thus, substantially contributes to environmental sealing. In a preferred embodiment the outwardly extending sealing flange and the peripheral lip both are disposed on the same elastomeric insert, and in particular on the elastomeric insert to be employed on the portable half of the connector. The elastomeric material enables a slight deformation of the sealing flange and peripheral lip as the connector halves are compressed together thereby achieving an exceptional environmental seal.

The connector further includes a coupling nut rotatably mounted to one of the connector halves and engagable with external threads on the other connector half. The coupling nut enables the secure interconnection of the two connector halves and tight seating of the sealing flange and peripheral lip.

The connector of the subject invention may further include a right angle adapter. The right angle adapter preferably is of unitary construction and is molded from a polyester elastomer having a high coefficient of friction. Preferably, the right angle adapter is formed from the same polyester elastomer from which the one-piece elastomeric inserts of the connector are formed. The right angle adapter is constructed to mechanically and frictionally engage the back end of the portable rigid outer shell. The cable is then urged through the adapter to undergo an angular transition approximately equal to or greater than 90°. Preferably, the right angle adapter is constructed to pass the cable through an angle substantially greater than 90°, and in a particularly preferred embodiment to pass the cable through an angle equal to or greater than 135°. This particular construction enables the standard connector to be used in situations requiring a right angle alignment of the cable, without resorting to a separate right angle connector half. The right angle adapter can be mounted by hand and provides the necessary strain relief for right angle applications.

Figure 8:
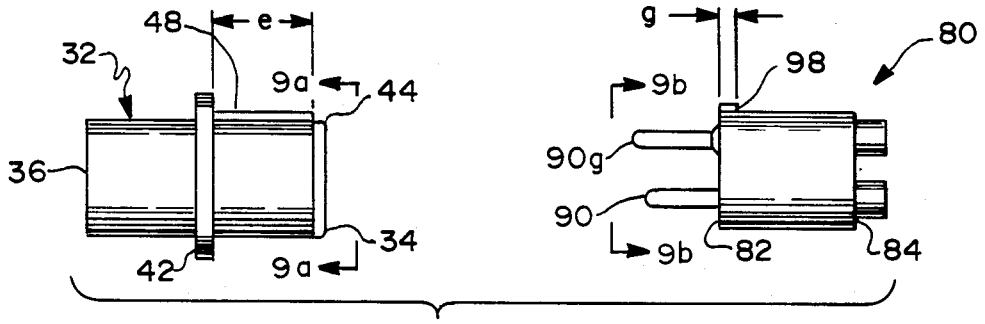
FIG. 8 is an elevational view of the insert of the subject connector shown in a disconnected condition.
Figure 9A:
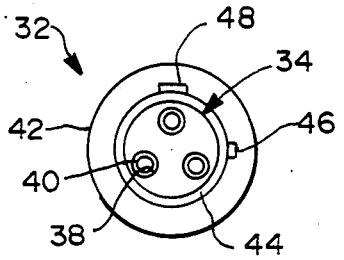
Figure 9B:
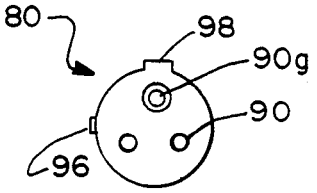

FIG. **9*a* is a front elevational view of the insert for the portable half of the connector as viewed from line 9*a*—9*a* in the FIG. 8**.

FIG. **9*b* is a front elevational view of the insert of the subject connector as viewed from line 9*b*—9*b* in FIG. 8**.

Figure 10:
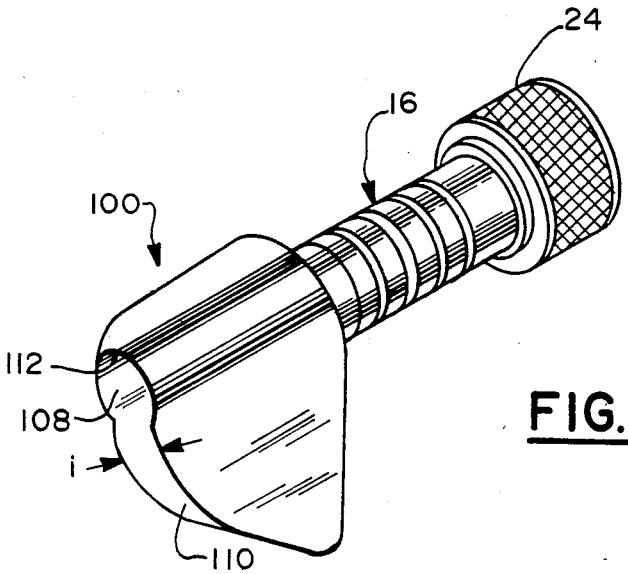

FIG. 10 is a perspective view of the right angle adapter of the subject invention mounted to the portable half of the subject connector.

Figure 11:
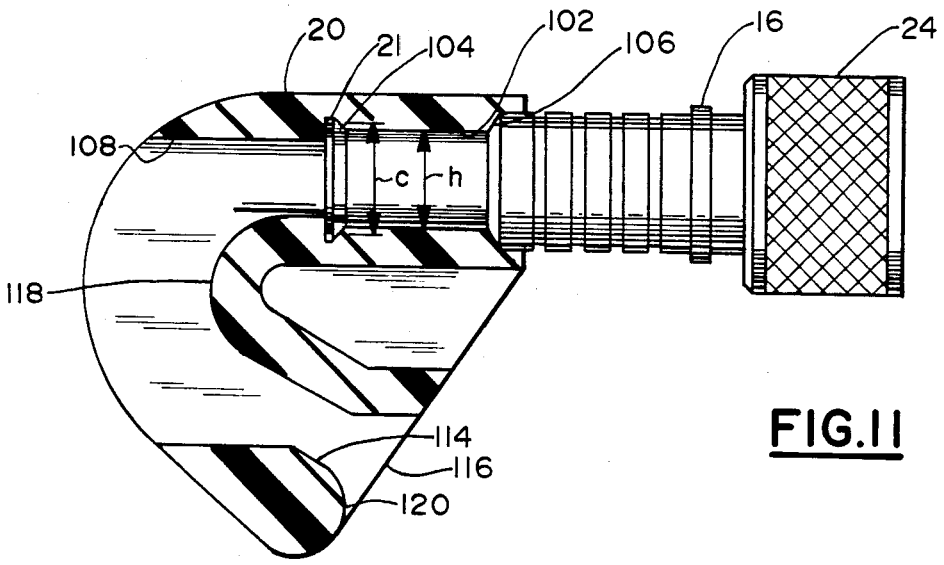

FIG. 11 is a cross-sectional view of the right angle adapter mounted to the portable half of the connector.

DETAILED DESCRIPTION OF THE PREFERRED EMBODIMENTS

Figure 1:
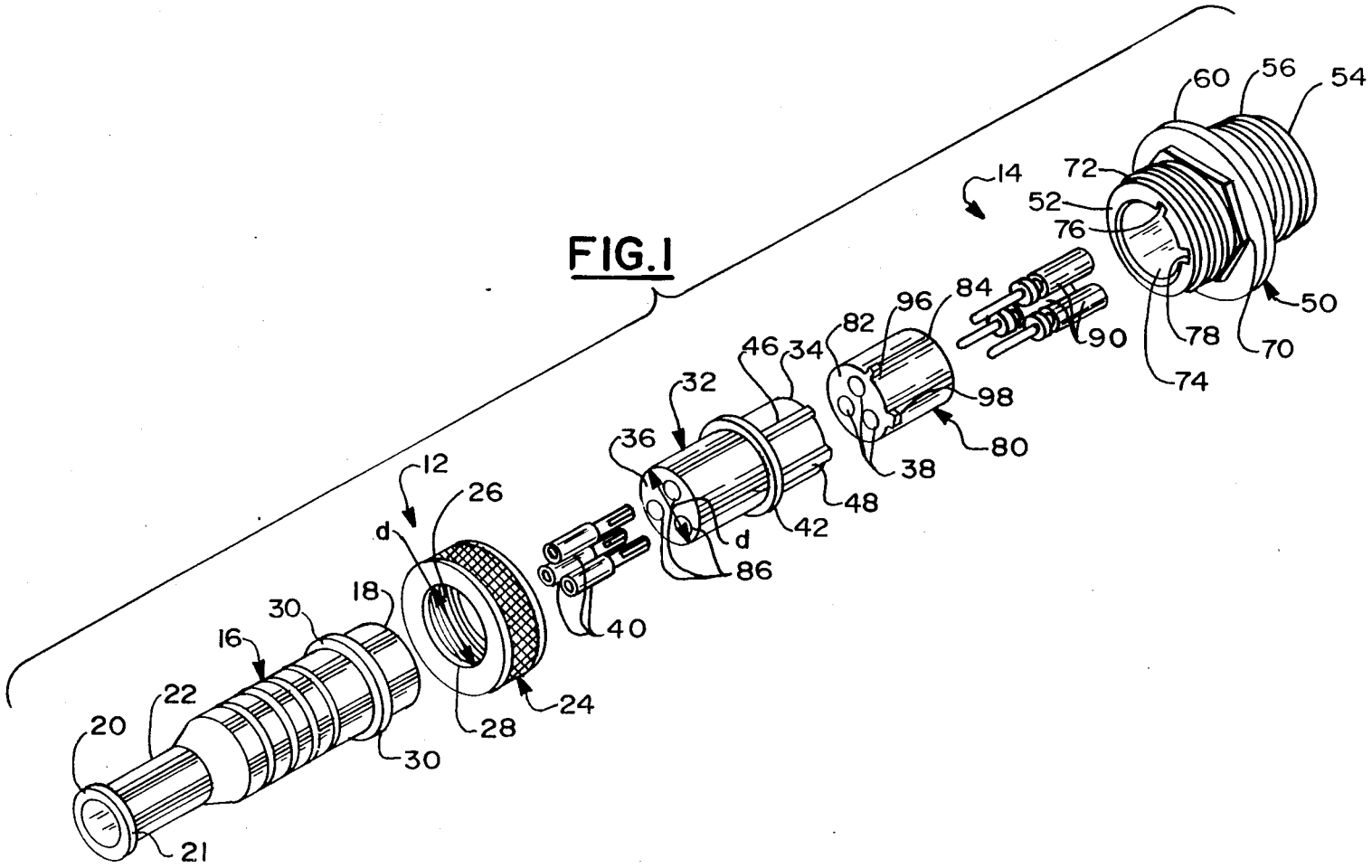
FIG. 1 is an exploded perspective view of the connector of the subject invention.
Figure 2:
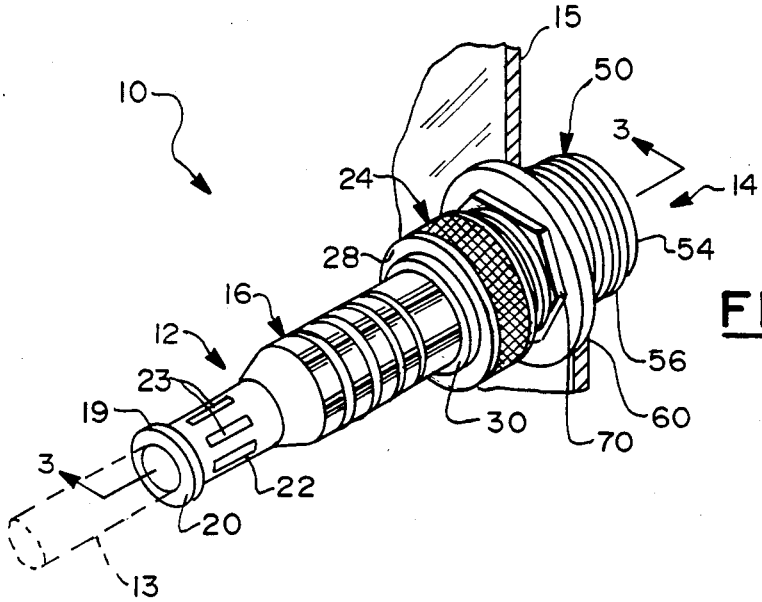
FIG. 2 is a perspective view of the connector of FIG. 1 shown in the assembled and mated condition.
Figure 3:
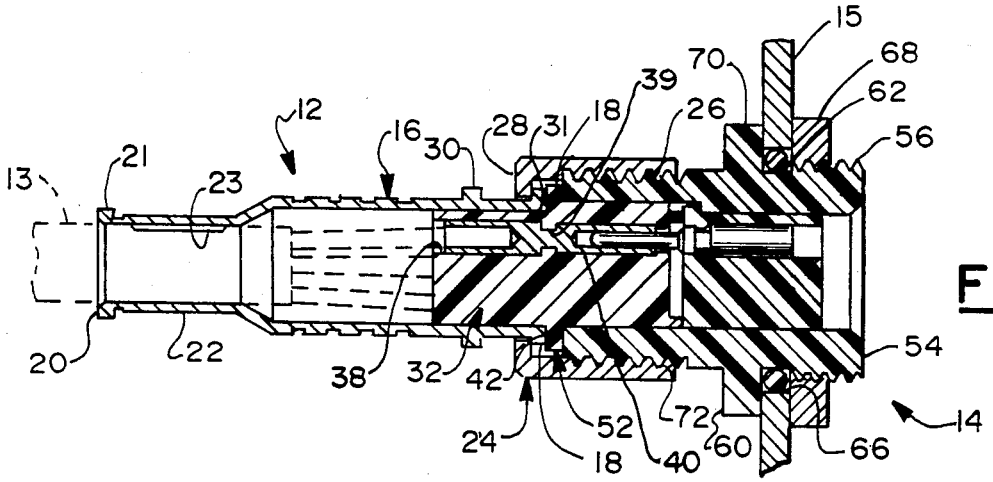
FIG. 3 is a cross-sectional view taken along line 3—3 in FIG. 2.
Figure 6:
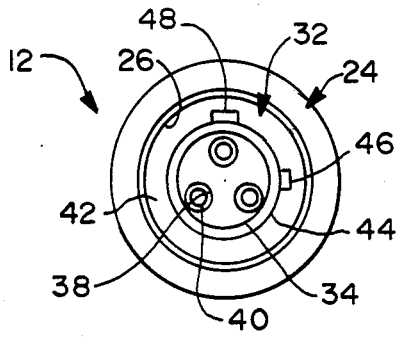
FIG. 6 is an elevational view of the portable half of the connector taken from line 6—6 in FIG. 4.
Figure 7:
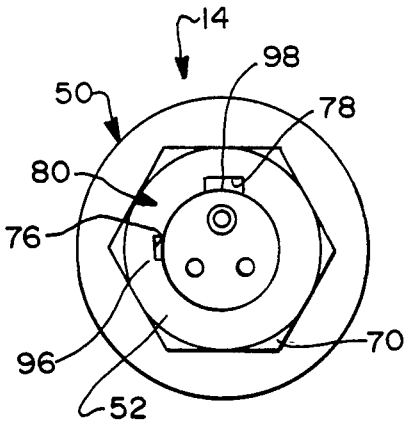
FIG. 7 is a front elevational view of the stationary half of the connector as viewed from line 7—7 in FIG. 5.

A preferred embodiment of the connector of the subject invention is indicated generally by the numeral 10 in FIGS. 1-3. The connector 10 includes a portable half 12 which is illustrated separately in FIGS. 4 and 6, and a stationary half 14 which is illustrated separately in FIGS. 5 and 7. The portable half 12 of connector 10 is constructed to be joined to a cable 13 as shown in FIGS. 2 and 3. The stationary half 14 of connector 10 is constructed to be mounted to a panel or electronic module 15 which also is schematically illustrated in FIGS. 2 and 3.

Figure 4:
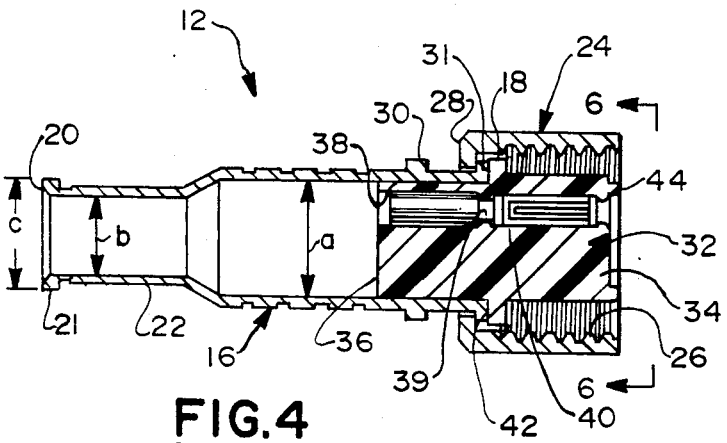
FIG. 4 is a cross-sectional view similar to FIG. 3 but showing only the portable half of the connector.

The portable half 12 of connector 10 includes a portable rigid outer shell 16 which preferably is formed from a metallic material offering desirable strength and corrosion resistance characteristics. A particularly preferred embodiment includes a portable rigid outer shell 16 formed from brass or a brass alloy with a corrosion resistant finish of zinc, chromium or nickel. The portable rigid outer shell 16 is of a generally cylindrical configuration defining a mating end 18 and a back end 20. The mating end 18 of the rigid outer shell 16 defines an opening of diameter "a" while the back end 20 defines an opening of diameter "b" as shown in FIG. 4. The inside diameter "b" of the back end 20 is substantially equal to the diameter of a cable 13 to be inserted therein. The back end 20 is flared to define a smooth, outwardly extending peripheral ridge 21 of outside diameter "c" which facilitates the entry of the cable 13 into the back end 20 of the portable rigid outer shell 16.

The portable rigid outer shell 16 of connector 10 further includes a generally tubular portion 22 substantially adjacent the back end 20. The tubular portion 22 is of a thickness to be mechanically crimped inwardly to securely retain the cable 13 within the rigid outer shell 16. The crimped connection of the rigid outer shell 16 to the cable 13 preferably achieves a reliable mechanical connection between the rigid outer shell 16 and the cable 13 inserted therein. More particularly, a plurality of inwardly extending crimps 23 are formed a sufficient depth into the tubular portion 22 of the outer shell 16 to deform the insulation of the cable 13 inwardly and to urge adjacent portions of the cable insulation outwardly and into close face-to-face contact with the areas of the outer shell 16 between adjacent crimps 23. It has been found that these crimp connections provide the strain relief connection required to surpass the 35 pound minimum established by UL standard 514. Additionally, the intimate face-to-face contact between the inner surface of crimps 23 on the rigid outer shell 16 and the deformed insulation of the cable 13 provides an adequate environmental seal which avoids resorting to other separate complex and costly seal structures at the back end 20 of the outer shell 16.

The rigid outer shell 16 is employed with a coupling nut 24 having an array of internal threads 26 and having an inwardly extending flange 28 at one end thereof. The inwardly extending flange 28 defines a diameter "d" as shown in FIG. 1 which enables the coupling nut 24 to be slidably inserted over the mounting end 18 of the portable rigid outer shell 16. The rigid outer shell 16 is initially formed with an outwardly extending flange 30 which defines a dimension greater than the diameter "d" of the inwardly extending flange 28 on coupling nut 24. As a result, the rearward axial movement of the coupling nut 24 over the rigid outer shell 16 is limited by the flange 30. After the coupling nut 24 has been slidably inserted over the rigid outer shell 16, the mating end 18 is deformed or staked over to define a second outwardly extending flange 31, as shown in FIGS. 3 and 4. The formation of this second flange 31 at the mating end 18 prevents removal of the coupling nut 24 from the rigid outer shell 16. Peripheral ridge 21 at back end 20 and coupling nut retaining flange 31 at mating end 18 are advantageously simultaneously formed in a single operation.

The portable half 12 of the connector 10 further includes a unitary dielectric insert 32 that is molded from a polyester elastomer having a high coefficient of friction. More particularly, the preferred insert 32 is molded from a HYTREL polyester elastomer having a SHORE A durometer hardness of 90 coupled with the above referenced high coefficient of friction. The one-piece elastomeric insert 32 is of generally cylindrical configuration and includes opposed mating and back ends 34 and 36 respectively. A plurality of generally longitudinally extending apertures 38 extend the entire distance through the elastomeric insert 32 and are dimensioned to receive female terminals 40. As illustrated herein, the terminals 40 which are slidably mountable in the apertures 38 of the elastomeric insert 32 define sockets. The apertures 38 include a stepped ridge 39 to control the axial position of terminals 40 therein.

The back end 36 of the elastomeric insert 32 defines a diameter "a" substantially equal to the inner diameter of the mating end 18 of the rigid outer shell 16. Thus, the back end 36 of the elastomeric insert 32 can be slidably force fit into the mating end 18 of the portable rigid outer shell 16. The use of the above described elastomeric material for the insert 32 provides desirable environmental sealing between the insert 32 and the outer shell 16. No additional sealing components therebetween are required. Additionally, the formation of the elastomeric insert 32 from a material having a high coefficient of friction ensures that the connector 10 will survive high torques and pulls without dislodging the insert 32 from the adjacent components of the connector 10.

The elastomeric insert 32 further includes an outwardly extending annular sealing flange 42 intermediate the opposed mating and back ends 34 and 36. The sealing flange 42 defines a diameter greater than the inside diameter "a" of the outer shell 16. Thus, the sealing flange 42 will be urged against the mating end 18 of the outer shell 16 thereby substantially contributing to the environmental sealing of the connector 10 in its fully assembled condition as shown in FIG. 3. This sealing flange 42 performs an additional sealing function with respect to the stationary half 14 of connector 10 as explained further below.

The mating end 34 of the elastomeric insert 32 is defined by an integral peripheral lip 44 extending forwardly and entirely thereabout, as shown most clearly in FIGS. 3, 4, 6, 8 and 9*a*. The peripheral lip 44 will mate with opposite surfaces on the stationary half 14 of connector 10 to further contribute to the environmental seal. The distance from the mating end 34, as defined by lip 44, to the sealing flange 42 is indicated by dimension "e" in FIG. 8. The elastomeric insert 32 is further provided with keys 46 and 48 which ensure proper alignment and polarity of the respective halves 12 and 14 of connector 10.

The stationary half 14 of the connector 10 includes a rigid outer shell 50 formed from a glass filled polyester that is exceptionally stiff and strong, and that performs comparably to metal parts. More particularly, the rigid outer shell 50 of the stationary half 14 has tensile and flexural strength over 30,000 psi and a heat deflection temperature over 220° Centigrade. A preferred glass filled polyester for the oute shell 50 is RYNITE FR-543. The stationary outer shell 50 includes opposed mating and back ends 52 and 54 respectively. The outer shell 50 includes an external array of threads 56 adjacent the back end 54. The external threads 56 are dimensioned to receive a corresponding array of internal threads on a fastening nut 58, as shown in FIGS. 2 and 3. The stationary outer shell 50 further includes an outwardly extending mounting flange 60 disposed intermediate the mating end 52 and the external threads 56 thereof. Preferably, the mounting flange 60 is spaced from the array of external threads 56 to define a channel 62 into which an elastomeric 0-ring 64 may be disposed for sealing purposes, as shown in FIG. 3. The back end 56 of the stationary outer shell 50 may be inserted through an aperture 66 in the panel or module 15, and may be secured in that position by tightening the nut 68. Thus, the panel 15 will be tightly engaged between the mounting flange 60 and the nut 68. To facilitate this tightening, the external portion of the stationary outer shell 50 adjacent the mounting flange 60 and intermediate the mounting flange 60 and the mating end 52 defines a hexagon 70 or other non-circular configuration. The hexagon 70 is dimensioned to be securely received by a standard dimensioned opened ended wrench.

Although external threads 56 are a preferred means for mounting outer shell 50 to panel 15, other mounting means may be employed. For example, back end 54 can be provided with a smooth surface instead of threads 56, including cut out portions extending therethrough. In accordance with this alternate arrangement, back end 54 of outer shell 50 may be slidably inserted into a mounting collar or sleeve provided in panel 15. A potting compound, such as a curable epoxy resin, can be used to fill the interior of back end 54. The potting compound 35 will flow through the cut out portions to contact the mounting collar. Upon curing, firm anti-rotational mounting of outer shell 50 to panel 15 is provided.

The external portion of the stationary outer shell 50 between the mating end 52 and the hexagon 70 defines an array of external threads 72. The external threads 72 are dimensioned to be engaged with the internal threads 26 on the coupling nut 24. As will be explained further below, this interengagement of the internal threads 26 on coupling nut 24 with the external threads 72 on the stationary outer shell 50 enables the secure mechanical and electrical interconnection of the connector halves 12 and 14.

Figure 5:
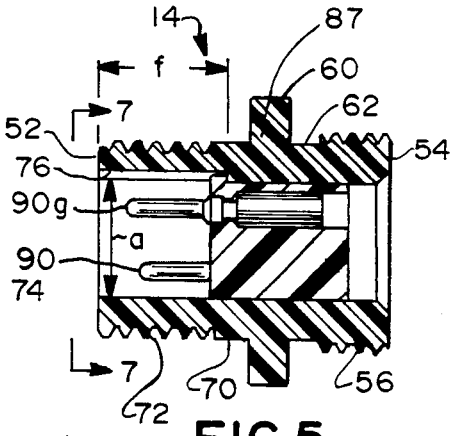
FIG. 5 is a cross-sectional view similar to FIG. 3 but showing only the stationary half of the connector.

The stationary outer shell 50 includes a generally cylindrical inner surface 74 of diameter "a" extending the entire distance between the mating and back ends 52 and 54 as shown in FIG. 5. This cylindrical inner surface 74 is further defined by longitudinally extending keyways 76 and 78 which extend distance "f" from the mating end 52. The keyways 76 and 78 are dimensioned and located to slidably receive the keys 46 and 48 on the elastomeric insert 32 described above.

The stationary half 14 of the connector 10 further includes an elastomeric insert 80 of generally cylindrical configuration. The elastomeric insert 80 is molded from the polyester elastomer having a high coefficient of friction as described with respect to the insert 32. The insert 80 includes opposed mating and back ends 82 and 84 respectively, and includes an array of longitudinally aligned apertures 86 which are dimensioned to receive the male terminals 90. As previously, the terminals 90 define pins as illustrated in these figures. The apertures 86 are characterized by ridges 87 which positively control the axial position of the respective terminals 90.

The generally cylindrical external configuration of the insert 80 is characterized by keys 96 and 98 which are dimensioned and located to be aligned with the keys 46 and 48 of the insert 32 and to be slidably received in the keyways 76 and 78 of the stationary outer shell 50. The keys have an axial length "g", which when added to the length "e" of the mating end of the insert 32 is equal to or slightly greater than the length "f" of keyways 76.

The connector 10 is assembled by slidably mounting the coupling nut 24 over the mating end 18 of the outer shell 16. The mating end 18 then is mechanically rolled over to define flange 31 and thereby prevent removal of the coupling nut 24 from the outer shell 16. The cable 13 then is inserted through the back end 20 of the portable outer shell 16, and the conductors therein are appropriately connected to the terminals 40. The terminals 40 then are slidably disposed in the apertures 38 of the molded elastomeric insert 32 such that the terminals 40 extend to a specified position relative to the opposed mating and back ends 34 and 36 of the insert 32 as determined by the ridges 39 therein. The high coefficient of friction of the polyester elastomer from which the insert 32 is molded ensures a secure retention of the terminals 40 in the respective apertures 38. The back end 36 of the insert 32 is then slidably advanced into the portable outer shell 16 until the sealing flange 42 thereof directly abuts the mating end 18 of the portable outer shell 16. As noted previously, the respective internal dimensions of the portable outer shell 16 combined with the high coefficient of friction characteristics of the insert 32 ensures a secure retention of the insert 32 within the portable outer shell 16. These dimensions and frictional characteristics of the insert 32 further contributes to an environmental seal for the portable half 12 of the connector 10.

Once the insert 32 has been properly seated within the portable outer shell 16, the tubular portion 22 of the outer shell 16 is mechanically crimped to achieve a secure mechanical connection to the cable 13 as shown in FIGS. 2 and 3. More particularly, the crimps 23 in portion 22 extend inwardly a sufficient distance to deform the insulation of the cable 13 and to urge portions of the insulation between adjacent crimps outwardly into secure face-to-face contact with the inner cylindrical surface of the outer shell 16. This crimping can be formed quickly and reliably by mechanical devices to ensure a secure strain relief connection of the cable 13 to the outer shell 16 and to provide an efficient environmental seal at the back end 20 of the portable outer shell 16.

The stationary half 14 of the connector 10 is similarly assembled by electrically connecting the terminals 90 to appropriate conductors (not shown) and extending the terminals and conductors through the stationary outer shell 50. The terminals 90 then are slidably inserted into the apertures 86 in the insert 80 such that the terminals are disposed at a preselected axial position relative to the insert 80 as defined by ridges 87. As shown most clearly in FIG. 5, one of the terminals **90*g* is dedicated as a ground and extends a greater axial distance than the other terminals 90. This construction ensures that the ground 90*g* will be connected prior to the other terminals 90**, thereby preventing sharp spikes or shorts.

Once the terminals 90 have been electrically connected to appropriate conductors and have been properly seated within the insert 80, the back end 84 of the insert 80 is slidably inserted into the mating end 52 of the stationary outer shell 50. To achieve proper seating of the insert 80 within the stationary outer shell 50, the insert 80 must be angularly oriented such that the keys 96 and 98 thereof are received within the keyways 76 and 78. The insert 80 is axially moved relative to the stationary outer shell 50 such that the keys 96 and 98 move the entire length of the keyways 76 and 78 and are fully seated therein, as shown most clearly in FIGS. 3 and 5. At or prior to this point in the assembly process, the stationary outer shell 50 may be securely mounted to a panel or module 68 by employing an appropriate fastening nut 58 as explained previously.

The portable half 12 of the connector 10 is assembled to the stationary half 14 by first rotationally aligning the portable half 12 such that the keys 46 and 48 on insert 32 can be slidably received within the keyways 76 and 78 of the stationary outer shell 50. The portable half 12 of the connector then is axially moved such that the insert 32 advances into the stationary outer shell 50. Complete advancement is achieved by tightening the coupling nut 24 onto the external threads 72 of the stationary outer shell 50. The complete tightening of the coupling nut 24 onto the stationary outer shell 50 will compress the sealing flange 42 of insert 32 against both mating ends 18 and 52 of the respective outer shells 16 and 50. This compression of the sealing flange 42 against the mating ends 18 and 52 will slightly deform the elastomeric material of sealing flange 42 and thus will substantially contribute to the environmental sealing of the connector 10.

The environmental seal of the actual electrical connection between respective pairs of terminals 40 and 90 is further achieved by the peripheral lip 44 at the mating end 34 of the insert 32. More particularly, as shown in FIG. 8, the sum of dimension "e" of the insert 32 and length "g" of keys 96 and 98 on insert 80 is equal or slightly greater than the length "f" of keyways 76 and 78 such that the tightening of the coupling nut 24 onto the outer shell 50 compresses the elastomeric peripheral lip 44 into the mating face 82 of insert 80. The connector 10 thus provides redundant environmental seals which include: the mating of the peripheral lip 44 against the mating face 82 of insert 80; the secure retention of the sealing flange 42 between mating faces 18 and 52; the crimping of the outer shell 16 to the cable 13; and the tight high friction fit between the inserts 32 and 80 and their respective outer shells 16 and 50.

As noted previously, several applications of the subject connector will require the cable 13 to be bent approximately 90° substantially adjacent the back end 20 of the portable half 12 of connector 10. Bends such as this can create substantial strains on the cables and the connectors. As a result, as noted previously, most prior art connectors require a special inventory of right angle connectors.

The subject connector, however, includes a right angle adapter that can be mounted to the portable outer shell 16 described above and illustrated in FIGS. 1–4. The right angle adapter is illustrated in FIGS. 10 and 11 and is identified generally by the numeral 100. The right angle adapter 100 is of unitary construction and is molded from the high coefficient of friction polyester elastomer described above with reference to the inserts 32 and 80. More particularly, it is preferred that the right angle adapter 100 be molded from the polyester elastomer HYTREL G-4075.

The right angle adapter 100 includes a generally cylindrical connector mounting channel 102 which is dimensioned to be slidably forced over the back end 20 of the portable outer shell 16. More particularly, the connector mounting channel 102 defines a diameter "h" which is less than the external diameter "c" defined by the rolled over flange 21 of back end 20 on the outer shell 16. Despite these relative dimensions, the ability of the polyester elastomer from which the right angle adapter 100 is molded to deform enables the connector mounting channel 102 to be urged over the back end 20 of the portable outer shell 16. Preferably, as shown in FIG. 11, the connector mounting channel 102 includes an annular groove 104 which is located and dimensioned to effectively engage the ridge 21 at the back end 20 of the portable outer shell 16. Additionally, the connector mounting channel 102 may define a flared entrance 106 which is dimensioned to conform to the external configuration of the outer shell 16.

The right angle adapter 100 includes an opened back end 108 through which a cable from the connector 10 may be threaded. As shown most clearly in FIG. 10, the opened back end 108 is of generally elongated configuration and of generally "key-hole" shape. Thus, the bottom portion 110 of the opened back end 108 is narrower than the top portion 112 thereof. The width, as indicated by dimension "i" in FIG. 10 of the narrow bottom portion 110 preferably is less than the diameter of the cable (not shown) which will extend from the outer shell 16.

The right angle adapter 100 further includes a cable channel 114 which extends from the opened back end 108 to a front opening 116. The cable channel 114 is angularly aligned to the connector mounting channel 102 at an angle equal to or greater than 90° and preferably equal to approximately 135°. The connector mounting channel 102 and the cable channel 114 preferably meet at arcuate surface 118 against which the cable is positioned. The edge surface 120 of the front opening 116 most distant from the mounting channel 102 also is of generally arcuate configuration to define a second smooth transition surface about which the cable may be positioned.

In use, the cable extending from the portable outer shell 16 is urged through the mounting channel 102 and through the larger top portion 112 of the opened back end 108. The right angle adapter 100 and the portable outer shell 16 then are urged toward one another such that the connector mounting channel 102 is forced over the back end 20 of the portable outer shell 16. The elastomeric characteristics of the adapter 100 will permit sufficient deformation to enable the enlarged back end 20 of the portable outer shell 16 to advance to the annular groove 104. The cable extending from the larger top portion 112 of the opened back end 108 is then looped back toward the narrower bottom portion 110 of the opened back end 108. The free end of the cable then is threaded through the narrower bottom portion 110 of the opened back end 108. The relative dimensions of the narrow portion 110 and the cable will require a slight deformation of the right angle adapter 100. The cable is completely threaded through the cable channel 114 such that the cable follows the arcuate contour 118 of the adapter 100 between the connector mounting channel 102 and the cable channel 114. In the embodiment of the adapter 100 shown in FIG. 11, the cable will extend through an angle greater than 90° as it extends around the arcuate portion 118. The cable may then be urged back toward a 90° alignment by following the arcuate surface 120 adjacent the front opening 116 of the cable channel 114. The arcuate surfaces 118 and 120 provide smooth transitions to prevent sharp bends and associated strains in the cable.

The right angle adapter 100 described above can be easily placed on the connector 10 by a technician at either the place of manufacture or in the field. The substantial surface contact between the cable and the high coefficient of friction polyester elastomer from which the adapter 100 is molded securely holds the adapter 100 in position relative to the outer shell 16 and the cable. Furthermore, the adapter 100 ensures a strain relief transition of the cable through an angle of at least 90°.

In summary, a simple yet extremely efficient electrical connector is provided along with a right angle adapter therefor. The connector includes opposed matable halves, each of which comprises a rigid outer shell and an elastomeric insert frictionally disposed within the respective outer shell. The inserts are adapted to slidably receive and frictionally retain terminals. The connector may include a stationary half and a portable half. The outer shell of the portable half of the connector includes a mechanically crimped strain relief connection to the .cable. The inserts each are of unitary construction and are molded from a polyester elastomer having a high coefficient of friction. Each insert includes keys which are alignable with keyways in one of the rigid outer shells. One of the inserts is further provided with an outwardly extending annular sealing flange which is tightened into contact with the mating ends of both external shells, thereby substantially contributing to the environmental sealing of the connector. One of the inserts is further provided with a forwardly extending peripheral lip that is urged into engagement with the mating face of the opposed insert. The right angle connector can be manually threaded onto the cable and one of the outer shells and frictionally held in place to provide a strain relief transition of the cable through 90°, thereby avoiding the need for separate right angle connectors.

While the invention has been described with respect to certain preferred embodiments, it is apparent that various changes can be made therein by those skilled in this art. For example, instead of making stationary outer shell 50 a separate part adapted to receive stationary insert 80, a unitary stationary outer shell and insert may be formed from the above described high coefficient of friction polyester elastomer. This unitary stationary outer shell and insert may include keys adapted to be non-rotatably force fit into compatible keyways of a panel. These and other embodiments would not depart from the scope of the invention as defined by the appended claims.

We claim:

1. An adapter to provide strain relief for an electrical connector having a cable extending therefrom, said adapter including a connector mounting channel whose ends are exposed to the exterior of said adapter, at least said connector mounting channel being dimensioned to be removably mounted to said electrical connector, said adapter further defining a cable channel angularly aligned at an angle substantially greater than zero degrees to said connector mounting channel and having ends which are exposed to the exterior of said adapter, at least a portion of said cable channel being dimensioned to frictionally retain the cable therein, whereby the connector mounting channel of the adapter may be mounted over the cable of the electrical connector and securely but removably mounted on the electrical connector, and whereby the cable may be threaded through and frictionally retained in the cable channel.

2. An adapter as in claim 1 including an arcuate surface extending between the connector mounting channel and the cable channel.

3. An adapter as in claim 2 wherein the cable channel and the connector channel intersect one another substantially adjacent an outer surface of said adapter.

4. An adapter as in claim 3 wherein the connector channel and the cable channel are aligned at an angle of greater than approximately 90°.

5. An adapter as in claim 2 wherein the adapter includes opposed front and rear ends, with said connector channel and said cable channel intersecting substantially adjacent the rear end of said adapter, said adapter including an arcuate strain relief portion adjacent the cable channel, said arcuate portion defining said arcuate surface over which the cable may be positioned.

* * * * *